US005669431A

United States Patent [19]

Druzynski et al.

[11] Patent Number: 5,669,431

[45] Date of Patent: Sep. 23, 1997

[54] GARAGE DOOR PANEL

[75] Inventors: Frank C. Druzynski, Daytona Beach; Ian J. Manser, Orlando, both of Fla.

[73] Assignee: Aluma Shield Industries, Inc., Deland, Fla.

[21] Appl. No.: 593,859

[22] Filed: Jan. 30, 1996

[51] Int. Cl.[6] ..... E06B 3/48

[52] U.S. Cl. ..... 160/229.1; 160/232; 160/236

[58] Field of Search ..... 160/201, 229.1, 160/232, 235, 236

[56] References Cited

U.S. PATENT DOCUMENTS

| | | | |
|---|---|---|---|
| 1,603,379 | 10/1926 | Dautrick . | |
| 1,630,680 | 5/1927 | Twedt et al. . | |
| 2,134,397 | 10/1938 | Clark . | |
| 2,252,737 | 8/1941 | Siess . | |
| 2,263,995 | 11/1941 | Katulski . | |
| 2,300,265 | 10/1942 | Siess . | |
| 2,549,301 | 4/1951 | Ferrell et al. . | |
| 2,871,932 | 2/1959 | Stroup . | |
| 2,892,494 | 6/1959 | Stroup . | |
| 2,951,533 | 9/1960 | Lucas et al. . | |
| 3,103,967 | 9/1963 | Gaschen . | |
| 3,118,702 | 1/1964 | Kale et al. | 160/201 |
| 3,148,724 | 9/1964 | Chieger et al. . | |
| 3,198,242 | 8/1965 | Crosswell . | |
| 3,302,690 | 2/1967 | Hurd . | |
| 3,302,692 | 2/1967 | Grau . | |
| 3,319,697 | 5/1967 | Krohn . | |
| 3,334,681 | 8/1967 | Crosswell . | |
| 3,347,305 | 10/1967 | Urbanick . | |
| 3,424,222 | 1/1969 | Stoner et al. . | |
| 3,891,021 | 6/1975 | Geoffrey . | |
| 3,941,180 | 3/1976 | Thill . | |
| 3,967,671 | 7/1976 | Stanley et al. . | |
| 4,269,253 | 5/1981 | Ziegler . | |
| 4,518,026 | 5/1985 | Otto et al. . | |
| 4,736,785 | 4/1988 | Seuster | 160/229.1 X |
| 4,771,816 | 9/1988 | Clay, Jr. | 160/201 X |
| 4,893,666 | 1/1990 | Hörmann . | |
| 4,924,932 | 5/1990 | Esnault . | |
| 4,989,660 | 2/1991 | Wagner | 160/201 |
| 5,002,114 | 3/1991 | Hörmann . | |
| 5,148,850 | 9/1992 | Urbanick . | |
| 5,170,832 | 12/1992 | Wagner . | |
| 5,419,386 | 5/1995 | Magro et al. | 160/232 |
| 5,564,164 | 10/1996 | Jella | 160/201 X |

FOREIGN PATENT DOCUMENTS

| | | |
|---|---|---|
| 369126 | 12/1982 | Austria . |
| 378237 | 7/1985 | Austria . |
| 382423 | 2/1987 | Austria . |
| 1310605 | 10/1962 | France . |
| 1396317 | 3/1965 | France . |
| 1555410 | 12/1968 | France . |
| 2220659 | 10/1979 | France . |
| 1509191 | 7/1969 | Germany . |
| 2106063 | 8/1971 | Germany . |
| 2103820 | 9/1971 | Germany . |
| 2903745B1 | 8/1980 | Germany . |
| 87078236 | 9/1987 | Germany . |
| 3816985A1 | 11/1989 | Germany . |
| 3726699C2 | 5/1994 | Germany . |
| 297311 | 3/1954 | Switzerland . |
| 516770 | 1/1940 | United Kingdom . |

*Primary Examiner*—Kenneth J. Dorner
*Assistant Examiner*—Bruce A. Lev
*Attorney, Agent, or Firm*—Harness, Dickey & Pierce, P.L.C.

[57] ABSTRACT

An overhead door includes a plurality of adjacent panels hinged to one another. Each panel includes a first and second side as well as a first and second edge. The first and second edges of adjacent panels are complementary with one another. The first edge includes a convex portion projecting from the panel and an abutting portion substantially continuous with an apex of the convex portion. The second edge includes a concave portion complementary with the convex portion and an abutting portion substantially continuous with the concave portion and which opposes the abutting portion of the first edge to form a butt joint. A gap is formed between the concave and convex portions of adjacent hinge panels. The gap has a width or thickness between the concave and convex portion which is constant. Also, the width or thickness remains constant as adjacent panels are articulated or rotated with respect to one another about the hinge.

19 Claims, 2 Drawing Sheets

GARAGE DOOR PANEL

BACKGROUND AND SUMMARY OF THE INVENTION

The present invention relates to overhead doors and, more particularly, to overhead or garage door panels.

Overhead or garage doors are utilized in all types of residential and commercial applications to close off various building openings. Also, these types of doors are utilized in over-the-road trucks. Ordinarily, the doors include horizontal panels which are hinged together and moved vertically with respect to the opening. The panels include rollers at their ends, which move in tracks, to assist in the vertical movement. As the doors move vertically, the panels articulate with respect to one another ordinarily creating an opening in between two adjacent panels about the hinge. It is desirable to prohibit the insertion of foreign objects between the adjacent hinge panels. Also, by providing closer tolerances, the inside of the structure is better sealed against the elements.

U.S. Pat. Nos. 5,002,114, 4,893,666 and 4,989,660 illustrate various types of door panels utilized in vertically moving overhead doors. U.S. Pat. No. 5,002,114, as well as U.S. Pat. No. 4,893,666, illustrate panels which have a gap between adjacent panels which gets smaller as the panels articulate with respect to one another. Also, these panels include a mortice and tenon joint. The U.S. Pat. No. 4,989,660 patent illustrates a symmetric tooth shaped member extending from the edge of the panel. While these patents appear to function satisfactorily, designers continue to strive to improve the art.

The present invention provides the art with an overhead door which includes a plurality of panels which are hinged together. The panels include first and second edges of adjacent panels which are complementary with one another. Opposing edges include a concave and convex surface, respectively, such that a gap is formed between the concave and convex surfaces. The gap has a width which is constant and remains constant during articulation of the panels with respect to one another. Also, the present invention provides the art with a door where the concave and convex surface portions are concentric with the axis of the adjoining hinge. Further, a seal is provided between adjacent mating edges which seals the two panels with respect to one another as well as prohibits the entrance of foreign objects between adjacent panels when the panels are in a full articulated position.

From the following detailed description, taken in conjunction with the accompanying drawings and subjoined claims, other objects and advantages of the present invention will become apparent to those skilled in the art.

DETAILED DESCRIPTION OF THE PREFERRED EMBODIMENT

Figure 1:
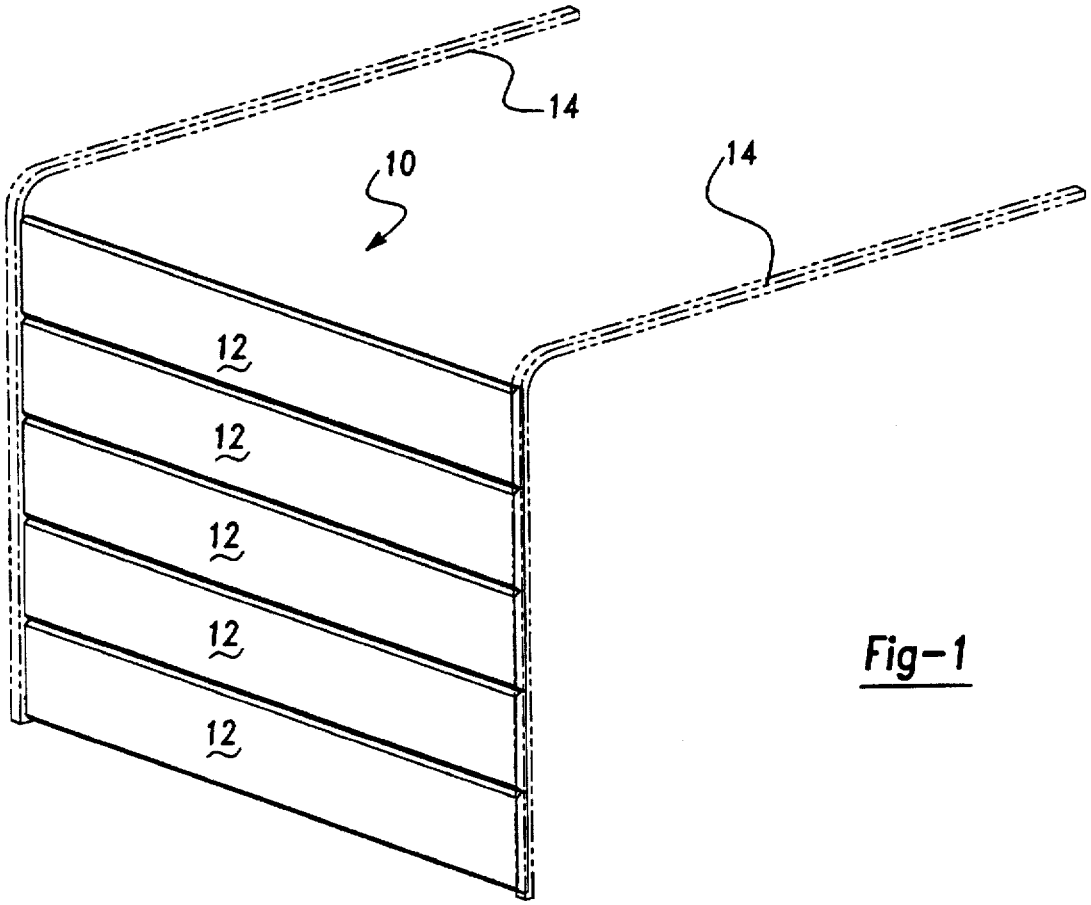
FIG. 1 is a perspective view of an overhead door in accordance with the present invention.

Turning to the drawings, an overhead door is illustrated and designated with the reference numeral 10. The overhead door 10 includes a plurality of horizontally extending panels 12 which move vertically to an open position via rollers (not shown) in rails 14. The overhead door of FIG. 1 may be utilized as a residential or commercial type of garage door or as a tractor trailer door.

Figure 2:
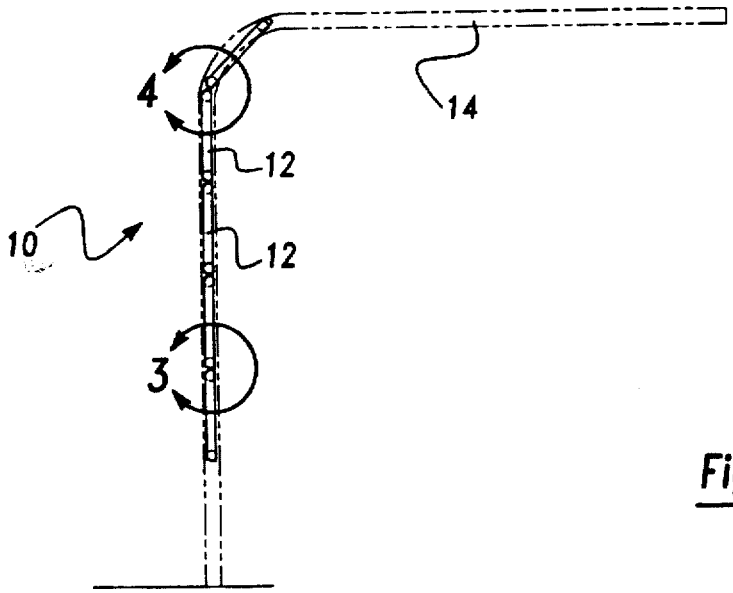
FIG. 2 is a side elevation view of the door of FIG. 1 in a partially retracted position.

Turning to FIG. 2, the door is illustrated in side elevation in a partially open position. Here, the panels 12 are shown in both an articulated position and a stacked position. The panels 12 are ordinarily identical, however the top panel and bottom panel may have a flat or straight edge since this edge is not used to mate with an adjacent panel. In this case, a seal may be positioned on the bottom panel to enable the overhead door 10 to seal with the ground. Also, the bottom panel 12 may include an edge like those to be described, wherein the seal would have a mating complementary configuration.

The panel 12 includes an outer metallic skin 20 with insulated material 22, such as an injected foam, within the metallic skin 20 which acts as an insulated material as well as securing the metallic front side 24 and rear side 26 with one another. The panel 12 also includes a first or top edge 28 as well as a second or bottom edge 30. The panel 12 is formed from two panels which may be stamped, extruded or the like, one including side 24, the other one side 26, and are positioned with respect to one another to form the panel 12. The sides 24 and 26 are ordinarily planar and as can be seen from the drawings are parallel with respect to one another.

A hinge 40 connects adjacent panels 12 for rotation or articulation with respect to one another. The hinge 40 includes a first member 42, a second member 44, and a pin 46 which secures the hinge members 42, 44 together. The first hinge member 42 includes a planar portion 48 which is secured to the back side 26 of the panel 12. The hinge member 42 also includes a cylindrical or barrel portion 50 which receives the pin 46. Likewise, the hinge member 44 includes a planar portion 52 to secure to panel side 26 as well as an angled portion 54 extending from the planar portion which includes a cylinder or barrel portion 56 at its end to receive pin 46. The pin 46 includes a center or axis point 60 which the hinge members rotate about.

The first edge 28 includes a projection 62 having a convex portion 64 and an abutting portion 66. The convex portion 64 is along an arc of a circle centered at the axis 60 of the hinge. The convex portion 64 extends between a step 68 and an apex 70. The abutting portion 66 is continuous with the apex 70. The abutting portion 66 is substantially planar and is continuous with the back or second side 26. The abutting portion 66 includes a recess 74 which receives a seal 76. The seal 76 seals adjacent panels with respect to one another as well as prohibits entrance of foreign objects when the panels are articulated with respect to one another as illustrated in FIG. 4.

The second edge 30 includes a convex portion 78 and an abutting portion 80. The convex portion 78 extends from a base 82 which is continuous with and perpendicular to the front or first side 24. The abutting portion 80 is continuous with the apex 84 of the concave portion 78. The curvature of the concave portion 78 is centered at the axis 60 of the hinge 40. Thus, the curvature or arc of the convex 64 and concave 78 portions are concentric with one another.

The abutting portion 80 is substantially parallel to abutting portion 66 such that seal 76 contacts abutting portion 80 to seal the panels 12 with respect to one another. The abutting portion 80 is continuous with and perpendicular to the second or back side 26 of the panel 12.

Figure 3:
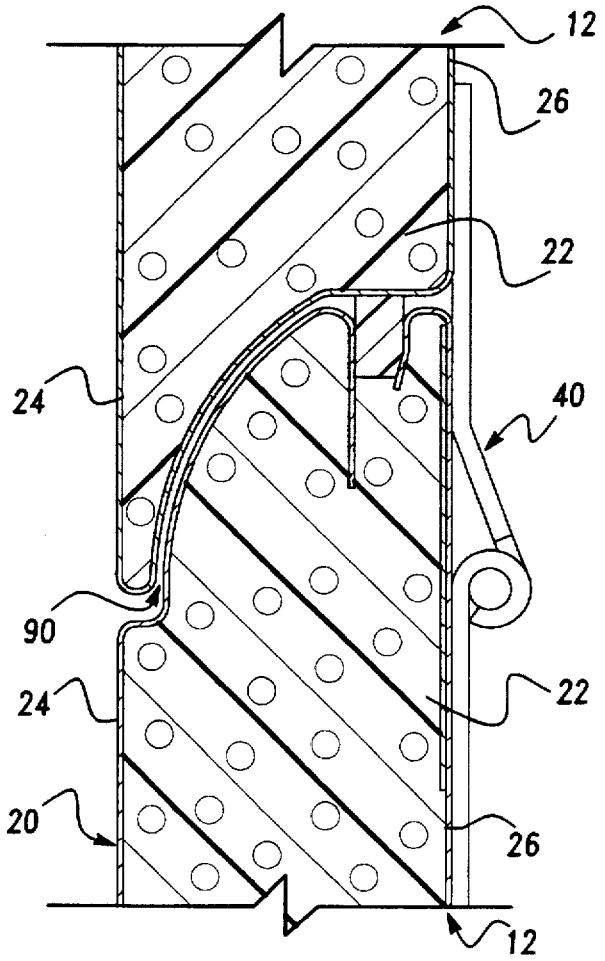
FIG. 3 is a cross-section view of FIG. 2 within circle 3.
Figure 4:
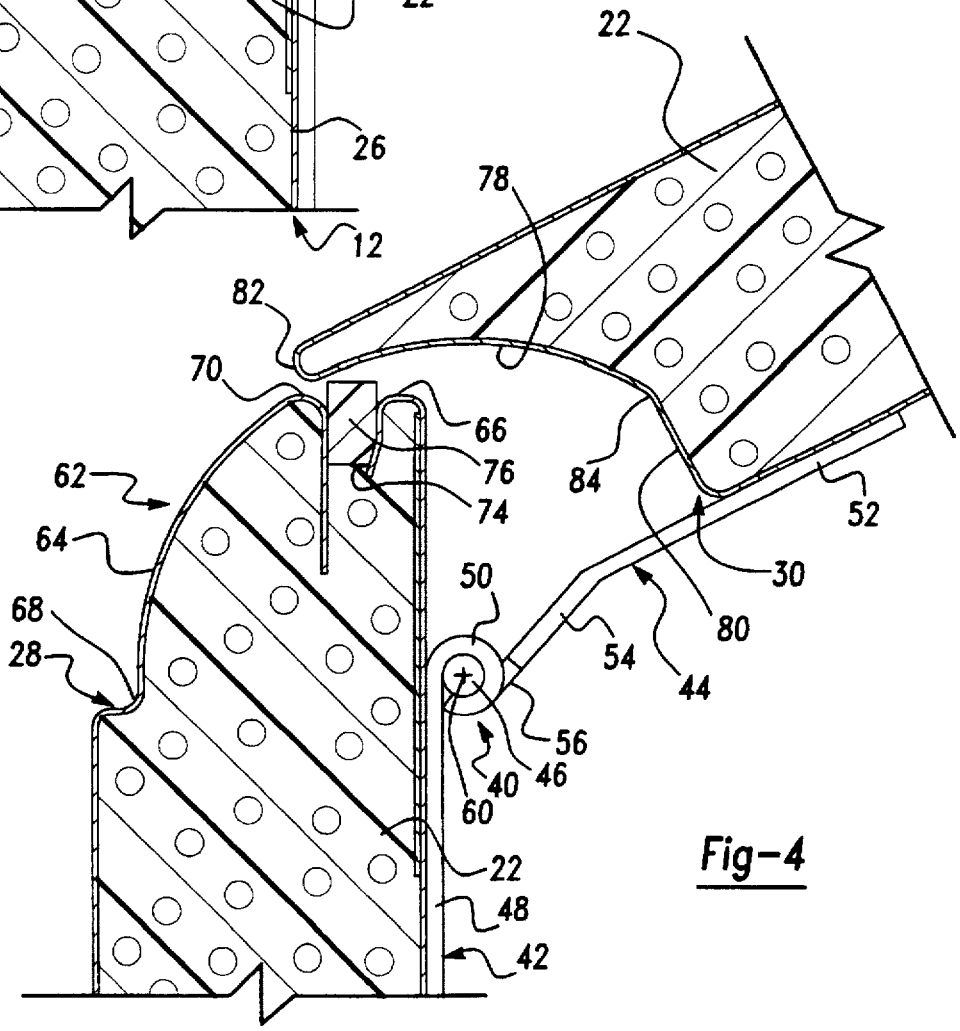
FIG. 4 is a view like FIG. 3 within circle 4 of FIG. 2 in a maximum articulated position.

When the panels are hinged together as illustrated in FIG. 4, a gap 90 is formed between the convex 64 and concave 78 portions. The gap 90 has a width or thickness which is substantially constant between the concave 78 and convex 64 portions. As the panels 12 are articulated with respect to one another, the width or thickness of the gap 90 remains constant through the articulation of the panels with respect to one another from a vertical position as illustrated in FIG. 3 to a maximum articulated position as illustrated in FIG. 4. Also, as seen in FIG. 4, at maximum articulation, the seal 76 prohibits the entrance of foreign objects. Thus, the panels provide a pinchless connection which keeps foreign objects out between adjacent panels at all times.

While the above detailed description describes the preferred embodiment of the present invention, the invention is susceptible to modification, variation, and alteration without deviating from the scope and fair meaning of the subjoined claims.

What is claimed is:

1. An overhead door comprising:

a plurality of panels adjacent one another, said adjacent panels hinged with one another, each panel including a first and second side as well as a first and second edge, said first and second edges of adjacent panels being complementary with one another, said first edge including a convex portion adjacent said first side and projecting from said panel and an abutting portion substantially continuous with and tangential to an apex of said convex portion, said abutting portion adjacent said second side, said second edge including a concave portion adjacent said first side and complementary with said convex portion and an abutting portion substantially continuous with and extending from said concave portion, said abutting portion of said second edge adjacent said second side and opposing said abutting portion of said first edge forming a butt joint; a gap formed between said concave and convex portions of adjacent hinged panels, said gap having a thickness between said concave and convex portions such that the thickness of said gap remains substantially constant as said adjacent panels are rotated with respect to one another about said hinge.

2. The overhead door according to claim 1, wherein said hinge being attached to one side of adjacent said panels, said panel side being substantially planar between and continuous with said abutting portions of said first and second edge.

3. The overhead door according to claim 1, wherein said abutting portion of said first edge includes a recess and a seal positioned in said recess.

4. The overhead door according to claim 3, wherein as said adjacent panels rotate with respect to one another about said hinge and as an end of said concave portion approaches said abutting portion of said first edge, said seal prohibits entrance of foreign objects between adjacent panels.

5. The overhead door according to claim 1, wherein said abutting portions are substantially planar.

6. The overhead door according to claim 1, wherein said convex portion being centered on an axis of said hinge.

7. The overhead door according to claim 1, wherein said concave portion being centered on an axis of said hinge.

8. The overhead door according to claim 1, wherein said concave portion and convex portion being concentric with respect to the hinge axis.

9. A door panel for an overhead door comprising:

a first and second side, a first edge and a second edge;

said first edge including a convex portion adjacent said first side and an abutting portion, said abutting portion substantially continuous with and tangential to the curvature of said convex portion and adjacent said second side;

said second edge including a concave portion adjacent said first side and an abutting portion, said abutting portion extending substantially from and continuous with the curvature of said concave portion and adjacent said second side.

10. The door panel according to claim 9, wherein said abutting portions are planar and substantially parallel to one another.

11. The door panel according to claim 9, wherein said abutting portion of said first edge includes a recess receiving a seal.

12. The door panel according to claim 9, wherein said concave portion and convex portion define concentric curvatures.

13. A door panel comprising:

a first and second side, a first and second edge;

said first edge including a convex portion adjacent said first side and an abutting portion, said abutting portion being substantially continuous with the curvature of and tangential to said convex portion and adjacent said second side;

said second edge including a concave portion adjacent said first side and an abutting portion, said abutting portion extending from and substantially continuous with the curvature of said concave portion and adjacent said second side, wherein when two panels are hinged adjacent one another, said first edge of one panel mates with the second edge of a second panel so that a gap is formed between the concave and convex surface, said gap having a constant width between the concave and convex surfaces and remains constant as the two panels are articulated with respect to one another.

14. The door panel according to claim 13, wherein said abutting portion of said first edge includes a recess and a seal positioned in said recess.

15. The door panel according to claim 14, wherein as said adjacent panels rotate with respect to one another about said hinge and as an end of said concave portion approaches said abutting portion of said first edge, said seal prohibits entrance of foreign objects between adjacent panels.

16. The door panel according to claim 13, wherein said abutting portions are substantially planar.

17. The door panel according to claim 13, wherein said concave portion and convex portion both being centered about the axis of the hinge.

18. The door panel according to claim 13, wherein said abutting portions are planar and substantially parallel to one another.

19. The door panel according to claim 13, wherein said concave portion and convex portion define concentric curvatures.

* * * * *